United States Patent [19]

Bacroix

[11] 4,434,821

[45] Mar. 6, 1984

[54] DEVICE FOR THE AUTOMATIC FILLING OF BOTTLES AND INSTALLATION CONTAINING SAME

[75] Inventor: Marcel A. Bacroix, Chalon sur Saone, France

[73] Assignee: Service de Propriete Indust. Centre de Recherches de Pont a Mousson, Paris, France

[21] Appl. No.: 317,731

[22] Filed: Nov. 3, 1981

[30] Foreign Application Priority Data

Nov. 6, 1980 [FR] France ..... 8023699

[51] Int. Cl.[3] ..... B65B 3/04

[52] U.S. Cl. ..... 141/44; 141/301; 55/355

[58] Field of Search ..... 55/355, 189, 319, 467, 55/459 R; 141/37, 39-66, 285, 295-310

[56] References Cited

U.S. PATENT DOCUMENTS 2,810,406 10/1957 De Milleville ..... 141/44

3,870,089 3/1975 Laub ..... 141/44

*Primary Examiner*—Houston S. Bell, Jr.

*Attorney, Agent, or Firm*—Sughrue, Mion, Zinn, Macpeak & Seas

[57] ABSTRACT

The apparatus comprises a vat (1) in the bottom of which a certain number of filling devices (22) are arranged around the axis of the vat. Each device contains a filling pipe in communication with the vat (1) and which is traversed by a vent tube which is connected at its top with a connection pipe (54) outside the vat and debouching in the upper part of an air-liquid separator (56). The lower part of this separator is connected to a vat of liquid (64) by means of a pipe (62). At its top it is connected by pipes (58) to a pipe (60) in which the pressure is lowered. Since the vat is mounted on a rotary shaft (4), the pipe (60) is connected to the pipe (58) by a rotary joint on the cover of the vat. Likewise, a pressurized pipe from the vat is mounted, by means of the same rotary joint, inside the cover of the vat.

11 Claims, 6 Drawing Figures

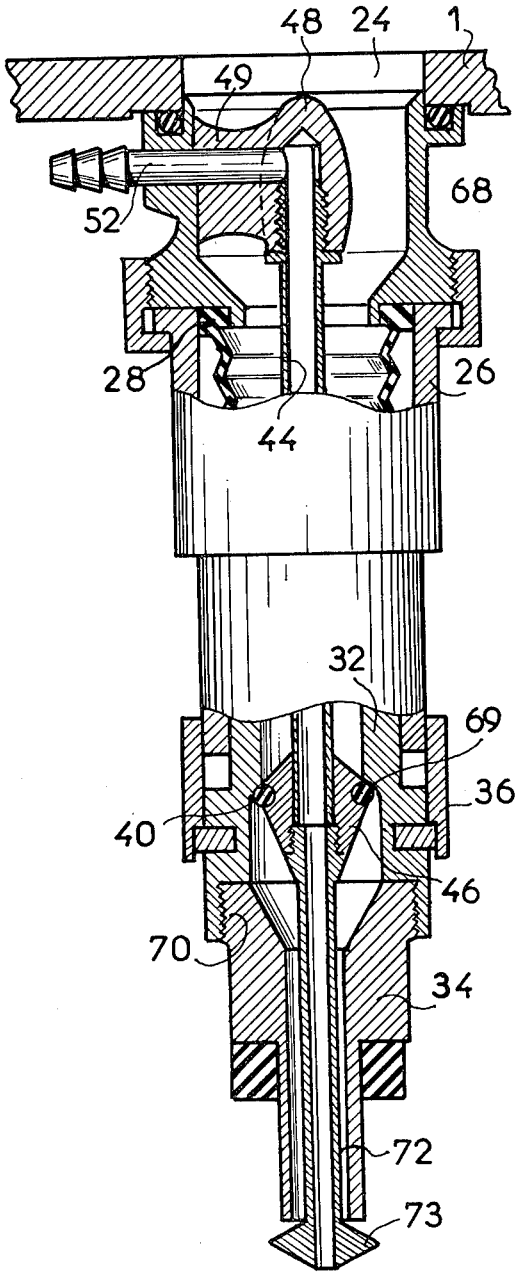
FIG.4
FIG.5
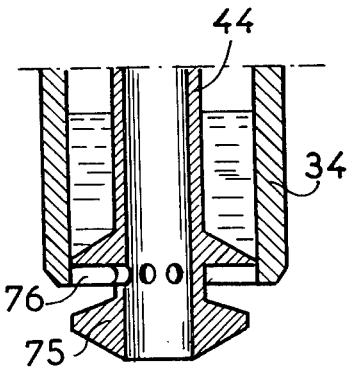

DEVICE FOR THE AUTOMATIC FILLING OF BOTTLES AND INSTALLATION CONTAINING SAME

The filling of bottles with non-gaseous or "flat" liquids is generally carried out by means of a filling apparatus, or tapping device, composed of a vat of liquid provided, for example on its periphery around a vertical axis, with a certain number of filling devices or tapping beaks. The bottles are brought in front of these beaks on a transporter, then moved vertically so that they themselves automatically control the filling.

For this purpose, known filling devices generally contain a filling pipe in constant communication with the vat, but movable vertically in relation thereto which is rigidly connected to a member which supports the bottle to be filled and which is traversed axially by a vent tube or tube for return of the air contained in the bottle to the vat, as well as a valve for closing the passage between the vent tube and the filling pipe which is opened by the upward movement of the bottle and closed by its descent.

In such devices the vent tube is maintained depressurized due to the fact that it exits into the vat which is itself depressurized. Consequently, at the end of the filling, when the liquid in the bottle reaches the lower end of the vent tube, the liquid rises in the vat through this tube. If, for any reason whatever, the bottle being filled is dirty or has been polluted, the liquid returned to the vat by the vent tube, which has been in contact with that bottle, could pollute the liquid in the vat and thus contaminate the contents of the bottles filled subsequently. The air from the bottle which is returned by the vent tube to the vat may also be polluting. Such a disadvantage could be particularly dangerous when the filling of the bottle is to be carried out under aseptic conditions.

The object of the present invention is to remedy this disadvantage by providing a filling device which provides for the elimination of all risks of return of polluted air or liquid to the filling vat.

In effect, the object of this invention is an automatic bottle filling device, in particular for "flat" liquids contained in a vat supplied with liquid, comprising a filling pipe in constant communication with the vat and movable vertically in relation thereto which is connected to a member which supports of the bottle to be filled and is traversed axially by a vent tube extending beyond the component for the support of the bottle and having a valve for closing the pipe, said valve being controlled by the movement of the bottle, characterized in that the vent tube debouches at its upper end into a pipe connected to a depressurization device, while the filling pipe and the vat are connected to a source of pressure.

Due to this arrangement, no return of liquid or air can take place from the bottle being filled in the direction of the vat of liquid. Moreover, the difference in pressure between the pressure of the liquid in the vat and in the filling pipe and the depressurization created at the end of the vent tube provides a large flow of liquid and thus accelerates the filling.

Preferably, the device comprises an air-liquid separator which is connected at its upper part to a vacuum source, and at its lower part to a liquid reservoir.

The liquid coming from the bottle and having traversed the vent tube is thus expelled into the reservoir without reaching the vacuum source.

The present invention also encompasses a filling apparatus containing several filling devices of the type set forth above, which are arranged along the periphery of the vat of liquid and are rotated along with it. This apparatus is composed of a pressurization pipe connecting a source of pressure to the vat of liquid, a liquid supply pipe from this same vat and a vacuum source outside the vat, which is connected to the upper end of each of the vent tubes of the filling devices.

According to a preferred embodiment, as the vat is driven in rotation with the filling devices, the pressurization pipe and the liquid supply pipe are connected to the vat by a same rotary joint.

The vacuum source can also be connected to the connection pipes and the vent tubes by means of the same rotary joint.

The depressurization source can also, according to one alternative embodiment, be connected to the vent tubes by a pipe traversing the drive shaft for rotation of the vat.

Whatever the embodiment selected, the liquid supply, the pressure and depressurization are centralized and simple.

The following description of embodiments given as nonlimitative examples and shown in the attached drawings, will moreover bring out the advantages and characteristics of the invention.

In the drawings:

FIG. 4 is a view analogous to FIG. 2 of an alternative embodiment of the filling device of the invention.

FIG. 5 is a detailed view showing an alternative embodiment of the flared head of the vent tube.

Figure 1:
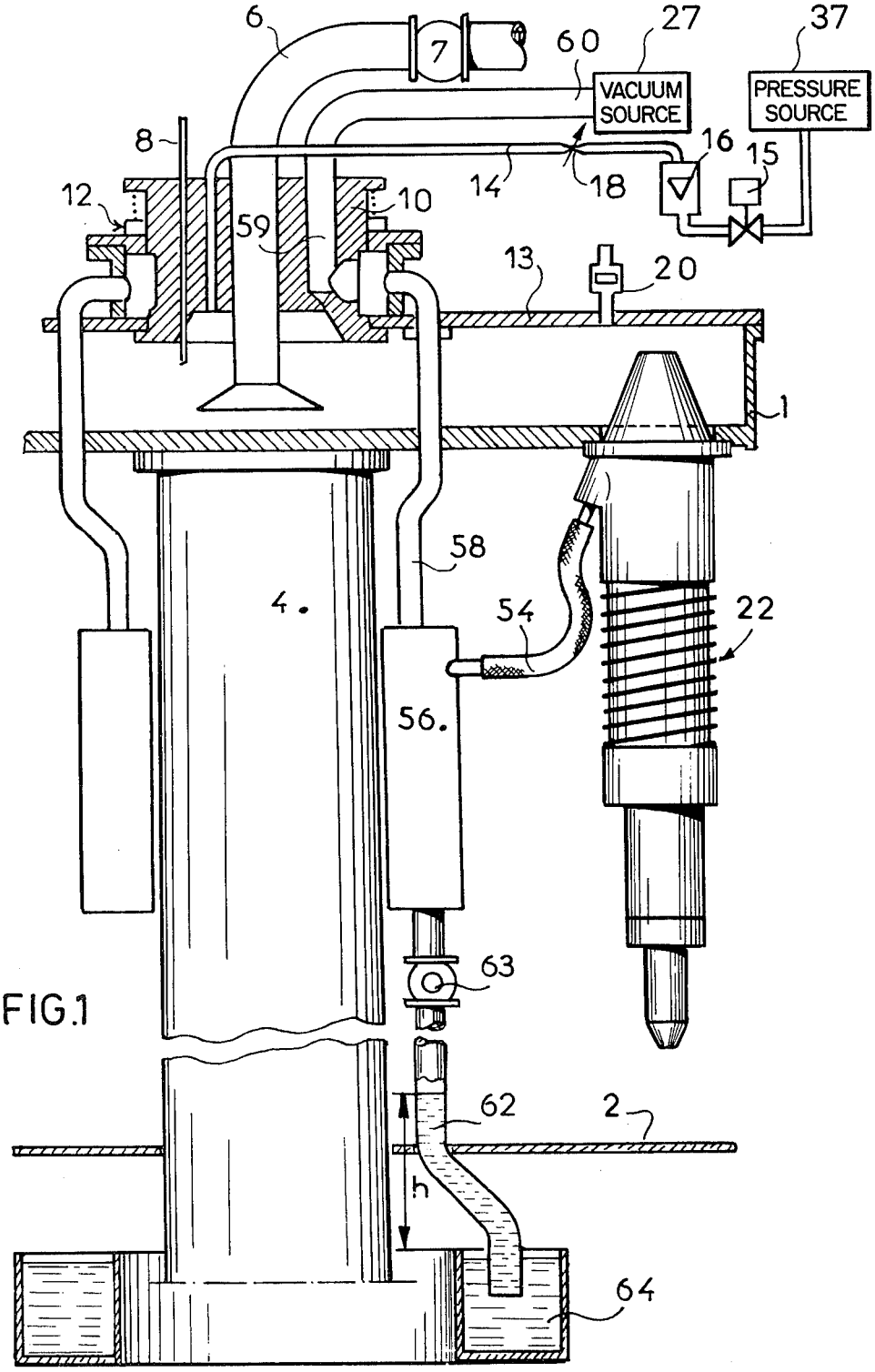
FIG. 1 is a partial view, of a cross-section along a vertical plane, of a filling apparatus according to the invention.

As is shown in particular in FIG. 1, a bottle filling apparatus comprises, generally, a vat 1 supplied with liquid to be distributed and a table 2 for the support of seats for the rise and descent of the bottles (not shown), which are both mounted on a common vertical shaft 4 which is rotated by a known device, which is not shown in order not to complicate the drawing.

The vat 1 is supplied with liquid by means of a pipe 6 provided with a valve 7 controlled by a probe 8 which detects the level of the liquid in the vat. The pipe 6, like the probe 8, are [sic] supported by a plug 10 fitted, by means of a rotary joint 12, into an orifice in the cover 13 of the vat 1. The plug 10 is also traversed by a pipe 14 for bringing sterile air or neutral gas under pressure, above the liquid in the vat. This pipe 14 is connected to a source of air or gas, pressure source 27 by means of a valve 15, a flowmeter 16 and a pressure regulator 18, the pressure in the vat being maintained constant by a stop valve 20 in the cover 13.

Figure 2:
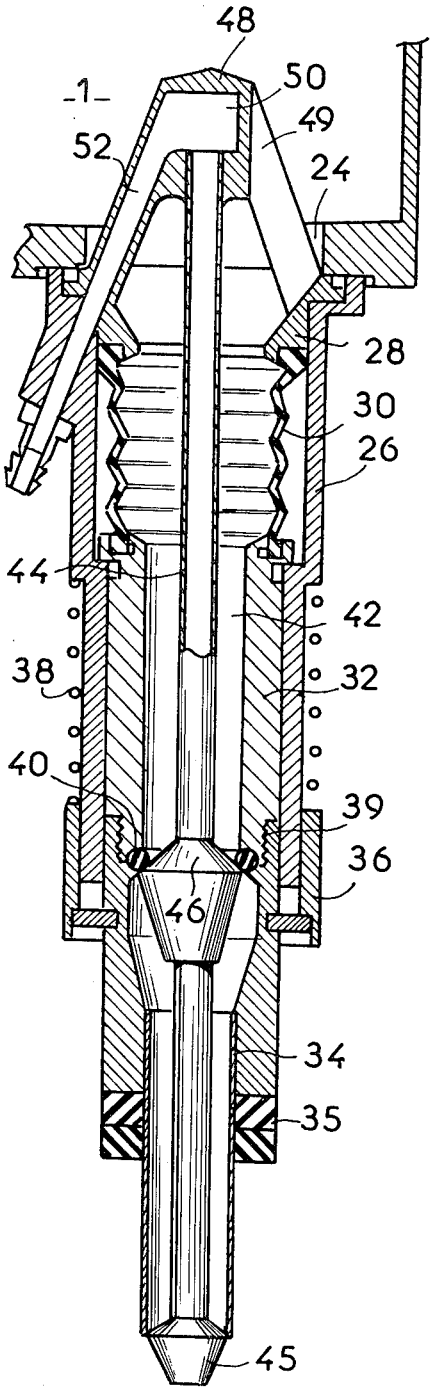
FIG. 2 is a schematic cross-sectional view, on a larger scale, of a filling device in accordance with the invention, used in the installation of FIG. 1.

Vat 1, moreover, supports, at its lower part, a certain number of filling devices 22 disposed along its periphery and thus arranged vertically above the seats borne by table 2. Each of these filling devices 22 is mounted in an orifice 24 in the bottom of the vat 1 (FIG. 2). It comprises a guide sheath 26 fixed, for example by screws which are not shown, on the bottom of the vat 1 around the orifice 24 and supporting a flow cone 28 connected by a bellows section 30 to a tubular sleeve 32. The sleeve 32 is movable in the sheath 26, but it is extended on the outside of this sheath by a tube 34 which is connected to an exterior sleeve 36, sliding on the sheath 26 and supporting a spring 38 which tends to push it downwards.

On the outside of tube 34, approximately at the middle of its length, is a sealing ring 35 forming a support component for the end of the neck of the bottle to be filled. In addition this tube 34 is fixed to the sleeve 32 by means of a screw thread 39 and to the right of this thread there is a groove into which a toroidal seal 40 is placed.

Figure 3:
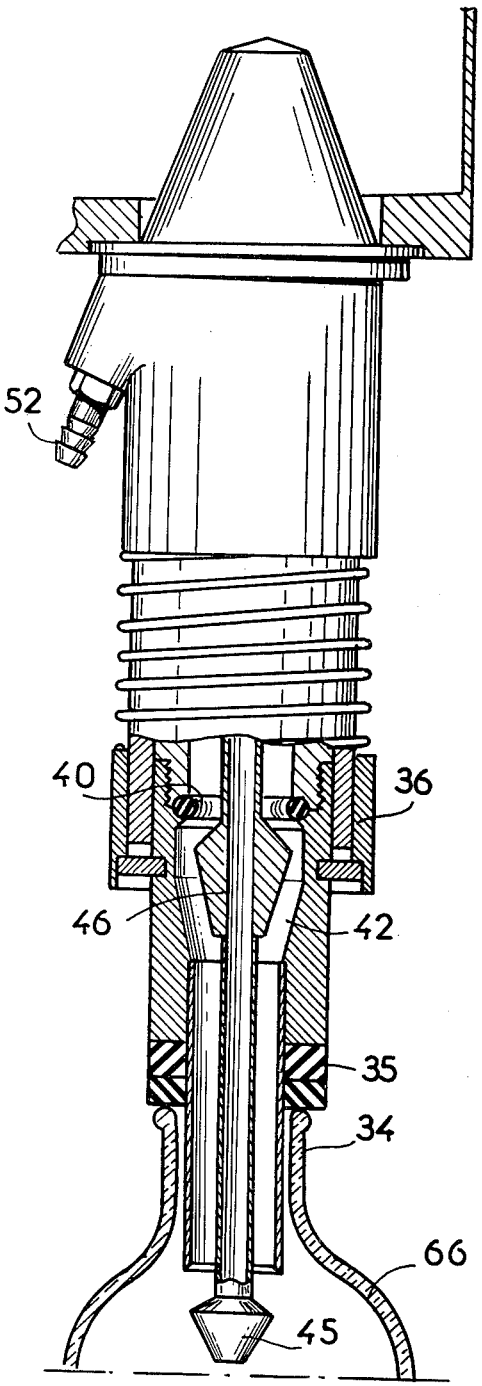
FIG. 3 is a schematic view, partially in cross-section, of the filling device of FIG. 2, in an operative position.

The assembly formed by the tube 34, the sleeve 32 and the bellows section 30 defines a filling channel which places orifice 24, that is vat 1, in communication with the bottle to be filled. This filling pipe 42 is traversed axially by a vent tube 44, which terminates at its lower end in a flared head 45 which can come into contact with the end edge of the tube 34 and close said it. In addition the vent tube 44 contains a valve 46, of a general double-cone shape, which cooperates with the toroidal seal 40 to close the filling pipe 42. This pipe 42 is moreover preferably flared to the right of the valve 46, in order to allow for the opening of said valve and provide a passage for fluid all around the valve, as is shown in FIG. 3.

The vent tube 44 extends into the vat 1 where it is fixed in a centering ring 48 connected by generally radial arms 49 to the flow cone 28. As is shown in FIG. 2, the centering ring 48 has a hollow interior and thus contains a cavity 50 which communicates, on the one hand with the vent tube 44, and on the other hand with a passage 52 provided in one of the radial arms 49. The passage 52 extends across the wall of the sheath 26 and is connected at the outside of this sheath by a passage 54 to a reservoir 56 connected at its upper part to a vacuum source 37.

The reservoir 56 is in effect connected by a pipe 58, which traverse vat 1 in a sealed manner, to a passage 59 provided in the plug 10 and connected by a pipe 60 to a vacuum source. At its lower part the reservoir 56 is connected by a pipe 62, provided with a valve 63, to a vat 64 which is open at the top and thus maintained at atmospheric pressure. Reservoir 56 plays the role of an airliquid separator for the fluid coming from the pipe 54 and from the vent tube 44. From this reservoir the air passes in the direction of the pipe 60 and of the vacuum source, whereas the water, or other liquid, is sent back to the vat 64.

Of course the reservoir 56, which is preferably annular and fixed on the rotary shaft 4, is connected to all the filling devices 22 and contains pipes 58, which are all connected by a common passage 59 to the depressurization pipe 60.

When it is desired to fill bottles, the valve 7 is first opened in order to fill the vat 1 of liquid to be distributed, to the level determined by the probe 8. At the same time valve 15 is opened in order to introduce aseptic air, or neutral gas under pressure, above the liquid by means of the flowmeter 16 and the pressure regulator 18. The vat 64 is, in addition, filled with water, or other liquid, so that the lower end of pipe 62 is in the water; then the vacuum source is activated, so that through the pipe 60, passage 59 and pipes 58, the reservoir 56 connected to the vent tubes of the filling devices is depressurized. The water in the vat 64 then rises in the pipe 62 by a height h which corresponds to the desired depressurization.

The assembly is then set in rotation and the bottles are brought up by the seats borne by the table 2. Each bottle to be filled is then raised by the seat which carries it until contact is made with the sealing ring 35 of the corresponding filling device, then it continues to rise carrying with it the filling pipe assembly, that is, in effect, the tube 34 and the sleeve 32, which on the one hand pushes sleeve 36 upwards against the action of spring 38, and on the other hand raises the toroidal seal 40 which is separated from the valve 46 and opens the filling channel 42. Similarly, tube 34 is separated from the flared head 45 of the vent tube opening the end of this tube. The filling device is then in the position shown in FIG. 3.

In this position the liquid contained in the vat, which of course also fills the filling pipe up to the valve 46, is free to pass beyond this valve and flow to the end of the tube 34 in order to reach the bottle 66 to be filled. During the filling of this bottle the air previously contained therein is forced back by the vent tube 44 in the direction of the reservoir 56 and of the depressurization source; the liquid contained in the vat 1 is, on the contrary, maintained at constant pressure due both to the level control probe which controls the opening of the valve and the arrival of the liquid, and to the supply of aseptic gas or neutral gas above the liquid. The difference between the pressure to which the liquid to be distributed is subjected and the vacuum pressure inside the vent tube is considerable and ensures rapid filling of the bottle 66.

When the liquid in the bottle 66 reaches the lower orifice of the vent tube 44, it blocks this orifice and prevents the continuation of the evacuation of the air. The liquid, however, continues to accumulate in the bottle 66 and begins to penetrate into the vent tube 44. However the amount of depressurization created in this vent tube is low and, moreover, this tube is small in size so that a considerable pressure drop is created in this vent tube when the liquid penetrates thereinto. The air pressure inside the bottle 66 therefore increases rapidly and balances itself with the pressure of the liquid in the filling channel. The flow then stops.

As soon as the bottle 66 thus filled begins to be lowered the tube 34 forced outwardly by the spring 38 which acts on the sleeve 36, redescends with it, which moves together the toroidal seal 40 and the valve 46 and soon closes it. At the same time the tube 34 comes into contact with the flared head 45 and thus closes the lower orifice of the vent tube.

As the bottle 66 continues to descend, the end orifice of the vent tube is freed and the liquid contained inside this tube tends to rise under the effect of the depressurization, up to reservoir 56. In this reservoir the liquid is separated from the air and sent back by the pipe 62 to the vat 64.

Another bottle can then be brought to the filling device 22 and in turn filled in the same manner.

Due to the presence of the reservoir 56 and of the vacuum source, the vent tube can play its role fully without risking pollution of the liquid in reserve in the vat. It is completely emptied of liquid before the placing of a new bottle. This bottle therefore incurs no risk of receiving liquid which has been in contact with the preceding bottle and, in addition, its filling can begin immediately after it is put in place.

FIG. 4 shows an alternative embodiment of the filling device in which the sheath 26 and the flow cone 28 are no longer fixed directly to the bottom of vat 1 but are fixed on a tubular ferrule 68 which carries the centering ring 48 and, consequently, the vent tube 44. The ring 48 is thus placed in the center of the ferrule 68, that is on the outside of vat 1. It is connected to this tip by at least one radial arm 49 traversed by a passage 52 for connection to the air-liquid separator reservoir 56.

In addition, in this embodiment the sleeve 32 extends beyond the seat 69 of valve 46 and itself carries sleeve 36 which slides on the outer surface of the sheath 26. The toroidal seal 40 is carried by the valve 46 itself so as to move with it and to be applied against the interior wall of the sleeve 32 which forms the seat 69. The tube 34 is screwed at 70 on this sleeve 32, beneath valve 46.

The vent tube 44, moreover, is made in two parts, an upper part which connects the centering ring 48 to the valve 46, and a lower part 72 fixed on the upper part, for example by screwing, and terminated at its lower part with a flared head or auxiliary valve 73. This head 73 can thus have an external diameter greater than the internal diameter of the tube 34, which enables it to provide better fluid distribution and better closing of the tube 34.

In another alternative embodiment, shown in FIG. 5, the flared head 75 of the vent tube is pierced with radial passages 76 which, in the closed position shown, debouch near the lower end of the tube 34 and thus allow for aspiration of the liquid flowing along the outside of this tube after the filling of a bottle. This film of liquid which has been in contact with the preceding bottle therefore no longer in any way risks spoiling the liquid for the following bottle.

The filling devices shown in FIGS. 4 and 5 can, of course, be used in the apparatus of FIG. 1 in the same manner as the filling devices of FIGS. 2 and 3. They can also, like said devices, be used in a slightly different apparatus such as that shown in FIG. 6.

In this drawing the vat 1 is rigidly connected to a rotary shaft 77 which is part of a base 78 carrying seats 80 for supporting the bottles 66 and rotated at its lower part. The shaft 77 is hollow and flares at its upper end in order to form an air-liquid separator reservoir 82, which is in communication through of pipes 84 with the vent tubes of each of the filling devices 22 of the apparatus. The shaft 77 is connected to a vertical tube 86 which extends it and debouches at its lower part into a fixed overflow basin 88. A fixed pipe 90 for vacuum supply axially traverses the entire length of the shaft 77 and of the tube 86 to be connected beneath the overflow basin 88 to a vacuum source, which is not shown, while its upper part debouches into the air-liquid separator 82.

The vent tubes of the filling devices 22 are thus depressurized by means of the pipes 84 of the separator 82, the pipe 90 and the vacuum source, which at the same time causes the liquid in the overflow basin to rise in tube 86 and form a liquid seal at the lower part of this tube. During filling the air expelled by the vent tube is aspirated into the pipe 90, while the liquid descends into the tube 86 towards the overflow basin 88. A return overflow pipe 92 from the basin 88 ensures a practically constant level inside this basin.

Thus, the same rapid, sure and aseptic filling facilities are obtained as with the installation of FIG. 1.

Figure 6:
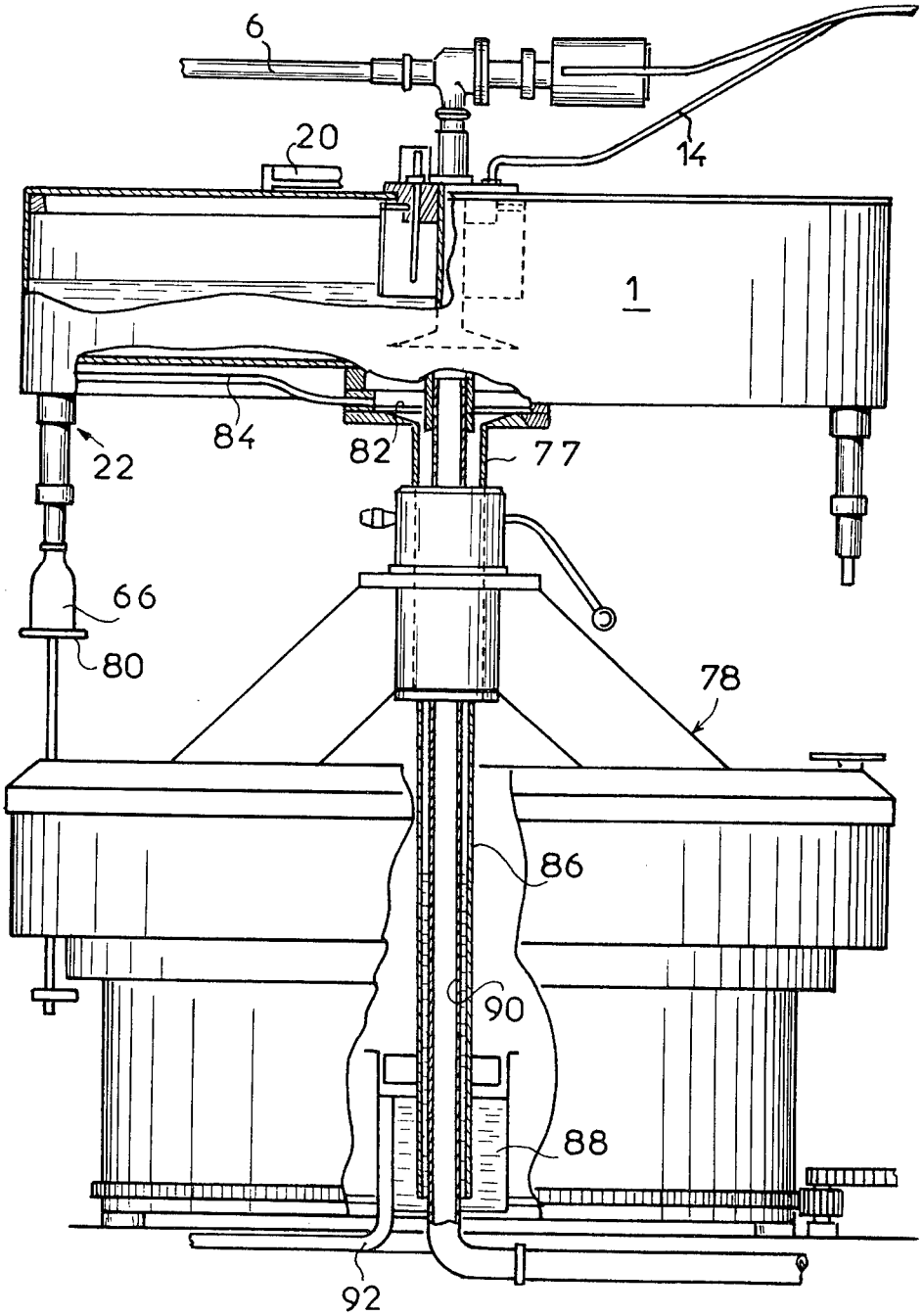
FIG. 6 is a front view, partial cut-away, of an alternative embodiment of the filling apparatus.

It is very obvious that in the same manner a filling apparatus can be constructed containing a fixed vat in place of the rotary vat of FIGS. 1 and 6.

In all the cases the filling device of the invention is simple, its cost is relatively low and it is very easy to clean.

I claim:

1. A device for automatically filling bottles, comprising:

A. a vat for holding a supply of a liquid to be filled into said bottles;

B. a liquid reservoir;

C. a vacuum source; and

D. at least one filling device, each said filling device comprising:

(1) a filling tube having an upper end in communication with the interior of said vat, said tube filling being vertically movable with respect to said vat;

(2) a vent tube axially traversing said filling tube and having a lower end below a lower end of said filling tube;

(3) a valve for opening and closing said filling tube in response to a position of a bottle to be filled;

(4) an air-liquid separator reservoir disposed below said vat and above said liquid reservoir, an upper end of said separator reservoir being communicated with an upper end of said vent tube and with said vacuum source; and (5) a pipe connecting a lower end of said separator reservoir to said liquid reservoir, wherein:

a lowered pressure created by said vacuum source in said air-liquid separator reservoir pulls liquid from said liquid reservoir into said pipe for a predetermined height.

2. The device of claim 1, further comprising a centering ring and a hollow arm, said upper end of said vent tube debouching into an interior cavity of said centering ring, and said hollow arm being communicated with said vacuum source.

3. The device of claim 2, wherein said vent tube comprises at said lower end a flared head for dispersion of liquid, said flared head forming a valve with said lower end of said filling tube, closing said lower end of said filling tube except when a bottle is in a position to be filled.

4. The device of any one of claims 1 and 3, wherein said vent tube comprises a first, upper part, and a second, lower part, said first and second parts being coupled to one another, an outer diameter of said lower end of said vent tube being substantially greater than said lower end of said filling tube.

5. The device of claim 3, wherein said flared head has an upper part having a diameter corresponding to an inside diameter of said filling tube, and radial passages for aspiration of liquid in said vent tube.

6. The device of any one of claims 1, 3 or 5, wherein said valve for opening and closing said filling tube comprises a toroidal seal supported by an inner surface of said filling tube, and a flared portion of said vent tube.

7. The device of any one of claims 1, 3 or 5, wherein said device further comprises a pipe for supplying liquid to said vat.

8. The device of claim 7, wherein said pipe connects with said vat at a radially central portion thereof, and wherein plural ones of said filling devices are provided, said plural ones of said filling devices being disposed in a circular configuration around said pipe.

9. The device of claim 7, further comprising a common rotary joint for coupling said pipe to said vat and said vacuum source of said separator reservoirs.

10. The device of claim 8, further comprising a rotary shaft for supporting said vat, said separator reservoirs being carried by said rotary shaft below said vat.

11. The device of claim 8, wherein said separator reservoirs are fixed to said vat, and further comprising a rotary shaft for supporting said vat, a first tube axially traversing said rotary shaft for connecting said vat to said pressure source, an overflow basin, and a second tube coaxial with said first tube for connecting said vat to said overflow basin.

* * * * *

UNITED STATES PATENT AND TRADEMARK OFFICE

CERTIFICATE OF CORRECTION

PATENT NO. : 4,434,821

DATED : March 6, 1984

INVENTOR(S) : Marcel André BACROIX

It is certified that error appears in the above-identified patent and that said Letters Patent is hereby corrected as shown below:

On page 1 of the Patent,
In the Assignment, kindly change the name of the assignee from "CENTRE DE RECHERCHES DE PONT A MOUSSON" to --PONT-A-MOUSSON, S.A.--.

Signed and Sealed this

*Twenty-sixth* Day of *February 1985*

[SEAL]

*Attest:*

DONALD J. QUIGG

*Attesting Officer* *Acting Commissioner of Patents and Trademarks*